US009688290B2

(12) United States Patent
Kim et al.

(10) Patent No.: US 9,688,290 B2
(45) Date of Patent: Jun. 27, 2017

(54) ELECTRIC RAIL CAR DOOR STRUCTURE

(71) Applicant: KOREA RAILROAD RESEARCH INSTITUTE, Uiwang-si (KR)

(72) Inventors: Moo Sun Kim, Seoul (KR); Jai-Sung Hong, Yongin-si (KR); Jae-Ho Lee, Suwon-si (KR); Kang-Mi Lee, Cheonan-si (KR); Dong-Uk Jang, Suwon-si (KR); Jung-Tai Kim, Seongnam-si (KR); Taesik Kim, Seoul (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 10 days.

(21) Appl. No.: 14/785,321

(22) PCT Filed: Apr. 29, 2014

(86) PCT No.: PCT/KR2014/003756
§ 371 (c)(1),
(2) Date: Oct. 16, 2015

(87) PCT Pub. No.: WO2014/185642
PCT Pub. Date: Nov. 20, 2014

(65) Prior Publication Data

US 2016/0075348 A1 Mar. 17, 2016

(30) Foreign Application Priority Data

May 15, 2013 (KR) ..... 10-2013-0054948

(51) Int. Cl.
*B61D 19/00* (2006.01)
*B61D 19/02* (2006.01)
(Continued)

(52) U.S. Cl.
CPC ..... *B61D 19/02* (2013.01); *B61D 19/005* (2013.01); *E06B 7/215* (2013.01); *E06B 2007/202* (2013.01)

(58) Field of Classification Search
CPC ..... B61D 19/00; B61D 19/02; B61D 19/005; B61D 19/006; B61D 19/007; B61D 19/008; B61D 19/009; E06B 7/215
See application file for complete search history.

(56) References Cited

U.S. PATENT DOCUMENTS 4,624,074 A * 11/1986 Shuttleworth ..... B60J 5/062 49/130
2005/0121939 A1* 6/2005 Griffis ..... B60J 5/0497 296/146.4

(Continued)

FOREIGN PATENT DOCUMENTS

KR 20-0124344 Y 2/1999
KR 20-0198692 Y 10/2000
KR 10-0785592 B 12/2007

OTHER PUBLICATIONS

International Search Report of PCT/KR2014/003756 dated Aug. 4, 2014.

*Primary Examiner* — Jason C Smith
(74) *Attorney, Agent, or Firm* — LEEPI

(57) ABSTRACT

A door structure of an electric rail car is provided to block outside noise and vibration. The door structure of the electric rail car includes a door frame, a guide rail and a sealing device. The door frame has an opening thereinside. The guide rail guides an opening and a closing of the door frame. The sealing device is inserted into the opening, descends to make contact with the guide rail when the door frame is closed, and ascends to be spaced apart from the guide rail when the door frame is open.

7 Claims, 4 Drawing Sheets

(51) Int. Cl.
*E06B 7/215* (2006.01)
*E06B 7/20* (2006.01)

(56) References Cited

U.S. PATENT DOCUMENTS

| | | | | |
|---|---|---|---|---|
| 2014/0020299 | A1* | 1/2014 | Takahashi | B61D 19/02 49/173 |
| 2015/0204126 | A1* | 7/2015 | Jetzinger | B61D 19/02 428/212 |
| 2016/0075348 | A1* | 3/2016 | Kim | B61D 19/02 105/343 |
| 2016/0280053 | A1* | 9/2016 | Joren | B61D 19/02 |

* cited by examiner

ELECTRIC RAIL CAR DOOR STRUCTURE

BACKGROUND

1. Field of Disclosure

The present disclosure of invention relates to a door structure. More particularly, the present disclosure of invention relates to an electric rail car door structure for blocking outside noise and vibration.

2. Description of Related Technology

Until now, a sealing device is not equipped to a lower portion of a door of an electric rail car, and thus outside noise and vibration are flowed inside of the electric rail car through a gap between a door frame and a guide rail.

FIG. 1 is a cross-sectional view illustrating a door structure of a conventional electric rail car. As illustrated in FIG. 1, a portion of the guide rail 2 is inserted into a lower portion of the door frame 1 and the door frame 1 is guided to be open or closed. However, a sealing device is not equipped between the door frame 1 and the guide rail 2, and thus the outside noise and vibration is flowed inside of the electric rail car through the gap between the door frame 1 and the guide rail 2.

Many prior arts are disclosed to minimize the gap 3 for blocking the influx of the outside noise and vibration, but the gap 3 may not be totally sealed in the above-mentioned structure. Thus, the outside noise and vibration may be easily flowed into the gap even though the size of the gap is decreased.

Accordingly, the door structure should be changed to totally block the outside noise and vibration.

SUMMARY

The present invention is developed to solve the above-mentioned problems of the related arts. The present invention provides to an electric rail car door structure capable of blocking outside noise and vibration without affecting an opening or closing operation of the door.

According to an example embodiment, the door structure includes a door frame, a guide rail and a sealing device. The door frame has an opening thereinside. The guide rail guides an opening and a closing of the door frame. The sealing device is inserted into the opening, descends to make contact with the guide rail when the door frame is closed, and ascends to be spaced apart from the guide rail when the door frame is open In an example embodiment, the door structure may further include a first magnet disposed at a side of the sealing device, and a second magnet disposed a side of the guide rail. The sealing device may descend due to attraction between the first and second magnets.

In an example embodiment, the door structure may further include an electric body having first and second ends. The first end may be connected to the side of the sealing device and the second end may be connected to a side of the door frame. The sealing device may ascend due to a restoring force of the electric body generated when the sealing device descends.

In an example embodiment, the door frame may include an outer wall and an inner wall, and the sealing device may include at least one protrusions which move outside of the door frame through a gap between the outer and inner walls.

In an example embodiment, the protrusion may include an electric material to tightly adhere to the outer and inner walls when moving, and tightly adhere to the guide rail when the door frame is closed.

In an example embodiment, two protrusions may be formed along a vertical direction substantially parallel with an extending direction of the door frame, and make contact with the guide rail when the door frame is closed.

In an example embodiment, a plurality of first magnets and a plurality of second magnets may be disposed along an opening and closing direction of the door frame, and the first magnets and the second magnets may be respectively disposed to face with each other such that the attraction may be generated when the first and second magnets are respectively arranged to face with each other.

In an example embodiment, an opening speed of the door frame may be determined such that the attraction between the first and second magnets may be negligible when the door frame is opening.

According to the example embodiments of the present invention, the opening or closing operation of the door is not affected, and the outside noise and vibration is not flowed into the inside of the electric rail car.

BRIEF DESCRIPTION OF THE DRAWINGS

The above and other features and advantages will become more apparent by describing exemplary embodiments thereof with reference to the accompanying drawings, in which.

DETAILED DESCRIPTION

Hereinafter, exemplary embodiment of the invention will be explained in detail with reference to the accompanying drawings.

A door structure of an electric rail car according to an example embodiment of the present invention includes a door frame, a guide rail and a sealing device. The sealing device is inserted into the door frame. The sealing device ascends when the door frame is open, and descends when the door frame is closed to make contact with the guide rail. Further detailed explanation will be followed referring to FIG. 2.

Figure 1:
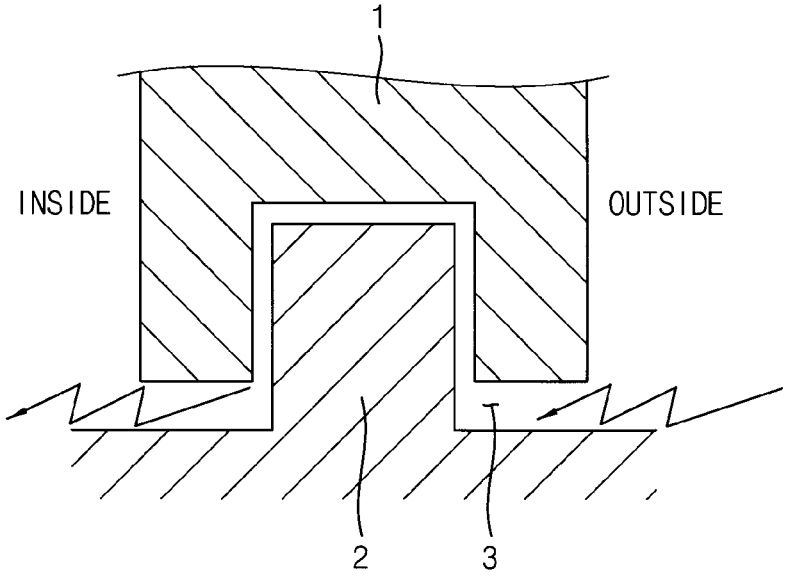
FIG. 1 is a cross-sectional view illustrating a door structure of a conventional electric rail car.
Figure 2:
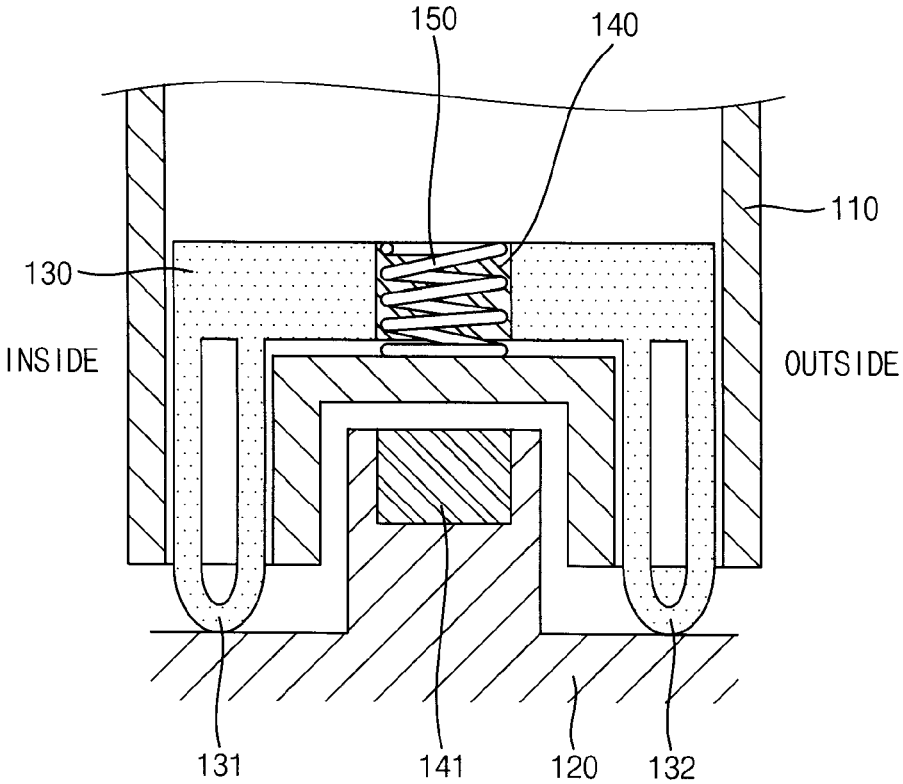
FIG. 2 is a cross-sectional view illustrating a door structure of an electric rail car in a state of closing according to an example embodiment of the present invention.

FIG. 2 is a cross-sectional view illustrating a door structure of an electric rail car in a state of closing according to an example embodiment of the present invention. As illustrated in FIG. 2, the door structure includes a door frame 110, a guide rail 120 and a sealing device 130.

The door frame 110, as illustrated in the figure, may include an opening which is formed inside of the door frame 110. The sealing device 130 is inserted into the opening, and moves inside of the opening. The door frame 110 may include an outer wall and an inner wall because of the opening. As mentioned below, the sealing device 130 tightly adheres to the outer and inner walls, and ascends and descends between the outer and inner walls.

The guide rail 120 is conventionally used, a portion of the guide rail 120 is inserted into a lower portion of the door frame 110 and guides the opening or the closing of the door frame 110.

The sealing device 120 descends to make contact with the guide rail 120 when the door frame 110 is closed, so that outside noise and vibration may be blocked. The sealing device 120 ascends to be spaced apart from the guide rail 120 when the door frame 110 is open, for example, the electric rail car stops. Accordingly, the sealing device 120 has no effect on the opening or the closing of the door frame 110.

In the present example embodiment, the sealing device 130 descends due to magnets. A first magnet 140 is disposed at a side of the sealing device 130, and a second magnet 141 is disposed at a side of the guide rail 120. Thus, attraction between the first and second magnets 140 and 141 may be generated, and thus the sealing device 130 is moved to the guide rail 120 to make contact with the guide rail 120.

Figure 3:
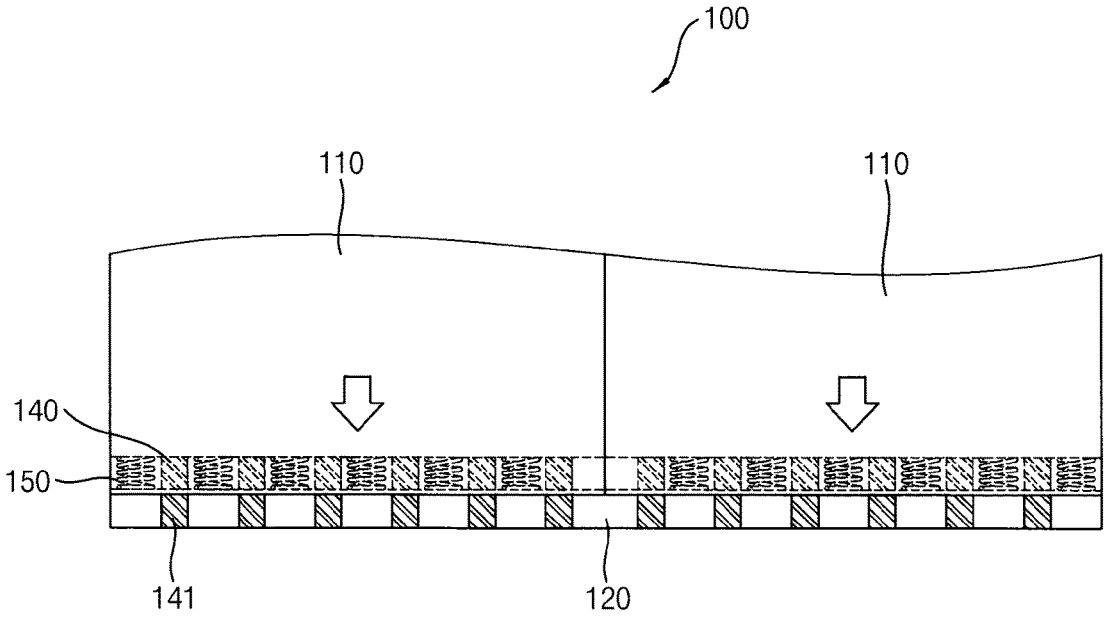
FIG. 3 is a front view illustrating the door structure of the electric rail car in the state of the closing.

FIG. 3 is a front view illustrating the door structure of the electric rail car in the state of the closing. As illustrated in FIG. 3, a plurality of first magnets 140 and a plurality of second magnets 141 may be arranged or disposed along an opening and closing direction of the door frame 110. When the first and second magnets 140 and 141 are respectively arranged to face with each other, the attraction is generated between the first and second magnets 140 and 141. For example, when the door frame 110 is closed, the first and second magnets 140 and 141 are respectively arranged to face with each other, as illustrated in FIG. 3, so that the sealing device 130 inserted into the opening of the door frame 110 descends to make contact with the guide rail 120.

Figure 4:
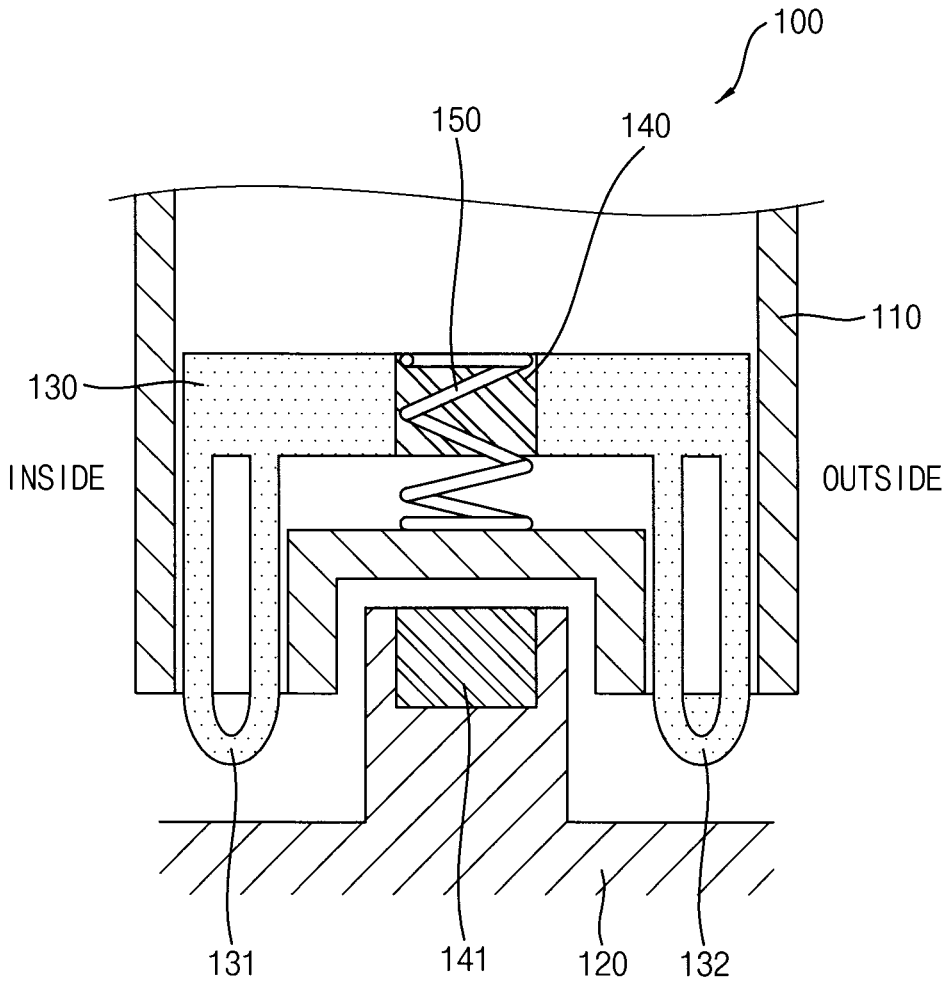
FIG. 4 is a cross-sectional view illustrating the door structure of the electric rail car in a state of opening.

The sealing device 130 ascends as follows. FIG. 4 is a cross-sectional view illustrating the door structure of the electric rail car in a state of opening. As illustrated in FIG. 4, when the door frame is open, the sealing device 130 ascends to be spaced apart from the guide rail 120, and thus the sealing device 130 does not block the opening of the door frame 1.

In the present example embodiment, the sealing device 130 ascends due to an elastic body 150 such as a spring. For example, a first end of the elastic body 150 is connected to the side of the sealing device 130, and a second end of the elastic body 150 is connected to the side of the door frame 110.

As mentioned above, when the door frame 110 is closed, the sealing device 130 descends, and thus the elastic body 150 lengthens according to the descending of the sealing device 130. The elastic body 150 is maintained with a lengthened state due to the attraction between the first and second magnets 140 and 141. Then, when the door frame 110 is open, the attraction between the first and second magnets 140 and 141 disappears, and thus the sealing device 130 ascends due to a restoring force (an elastic force) of the elastic body 150.

Figure 5:
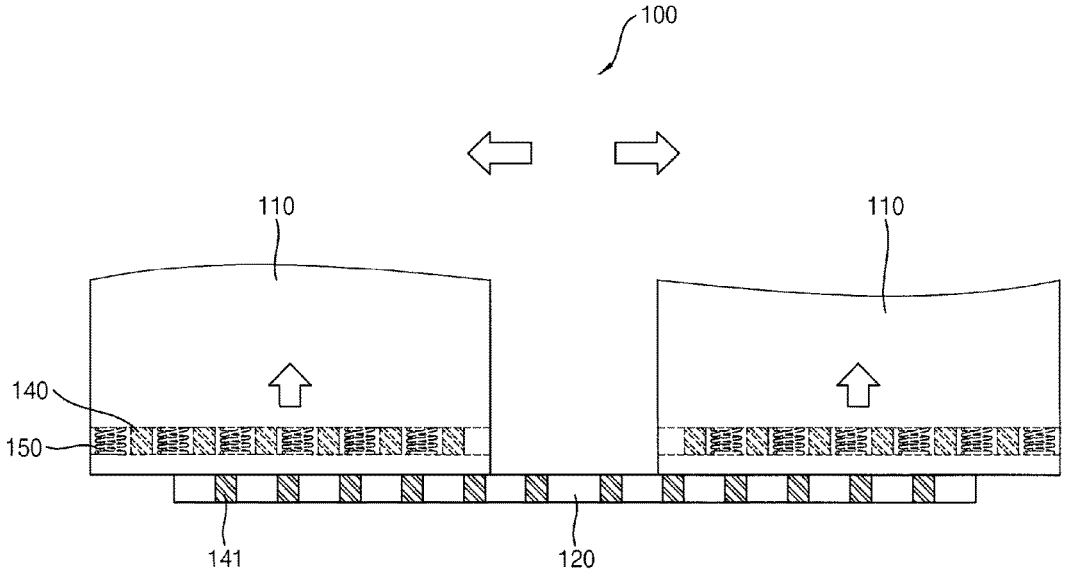
FIG. 5 is a front view illustrating the door structure of the electric rail car in the state of the opening.

FIG. 5 is a front view illustrating the door structure of the electric rail car in the state of the opening. As illustrated in FIG. 5, when the door frame 110 is open, the first and second magnets 140 and 141 is misaligned with each other, in which the first and second magnets 140 and 141 do not face with each other respectively, and thus the attraction between the first and second magnets 140 and 141 disappears and the restoring force of the elastic body 150 only applies to the sealing device 130. Thus, the sealing device 130 ascends again.

Referring to FIGS. 2 and 4 again, the door frame 110 includes an outer wall and an inner wall. The sealing device 130 includes at least one protrusions 131 and 132. The protrusions 131 and 132 may move between the outer and inner walls. In the present example embodiment, two protrusions 131 and 132 are disposed along the opening and closing direction of the door frame 110. For example, the first protrusion 131 extends along an extending direction of the inner wall adjacent to the inner wall, and the second protrusion 132 extends along an extending direction of the outer wall adjacent to the outer wall. The first and second protrusions 131 and 132 are arranged parallel with each other. When the door frame 110 is closed, the protrusions 131 and 132 may make contact with the guide rail 120. Accordingly, the outer noise and vibration may be doubly blocked.

In addition, each of the protrusions 131 and 132 includes an elastic material. Thus, each of the protrusions 131 and 132 tightly adheres to each of the inner and outer walls, and tightly adheres to the guide rail 120 when the door frame 110 is closed. In addition, the protrusions 131 and 132 less wears due to foreign substance.

Referring to FIG. 5 again, when the door frame 110 is open, the first and second magnets 140 and 141 are misaligned with each other not to induce the attraction between the first and second magnets 140 and 141. For example, when the door frame 110 is open, the door frame 110 does not stop as illustrated in FIG. 5, but the door frame 110 moves along a direction in which each of a pair of door frames goes apart. Thus, the first and second magnets 140 and 141 are aligned to face with each other and are misaligned not to face with each other (align/misalign) repeatedly, or are matched with each other and are not matched with each other (match/mismatch) repeatedly. However, when the door frame 110 opens with a relatively high speed, the first and second magnets 140 and 141 do not have enough time to induce the attraction and the attraction between the first and second magnets 140 and 141 disappears shortly. Accordingly, the attraction between the first and second magnets 140 and 141 may be controlled based on the opening speed of the door frame 110. In the present example embodiment, the opening speed of the door frame 110 is determined such that the attraction between the first and second magnets 140 and 141 is negligible. Here, the opening speed of the door frame 110 is maintained relatively high enough not to be affected by the attraction between the first and second magnets 140 and 141, and the attraction is much smaller than the restoring force of the elastic body 150 so that the sealing device 130 may ascend due to the restoring force again. As the opening speed increases, the attraction is more negligible. However, the opening speed of the door frame 110 may be determined considering a safety of passengers, the restoring force of the spring (for example, a length or an elastic coefficient of the elastic body 150), and so on.

The foregoing is illustrative of the present teachings and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A door structure of an electric rail car comprising:

a door frame having an opening thereinside;

a guide rail guiding an opening and a closing of the door frame;

a sealing device inserted into the opening, descending to make contact with the guide rail when the door frame is closed, and ascending to be spaced apart from the guide rail when the door frame is open; and an electric body having first and second ends, the first end being connected to the side of the sealing device, the second end being connected to a side of the door frame, wherein the sealing device ascends due to a restoring force of the electric body generated when the sealing device descends.

2. The door structure of claim 1, further comprising:

a first magnet disposed at a side of the sealing device; and a second magnet disposed a side of the guide rail, wherein the sealing device descends due to attraction between the first and second magnets.

3. The door structure of claim 2, wherein a plurality of first magnets and a plurality of second magnets are disposed along an opening and closing direction of the door frame, and the first magnets and the second magnets are respectively disposed to face with each other such that the attraction is generated when the first and second magnets are respectively arranged to face with each other.

4. The door structure of claim 3, wherein an opening speed of the door frame is determined such that the attraction between the first and second magnets is negligible when the door frame is opening.

5. The door structure of claim 1, wherein the door frame comprises an outer wall and an inner wall, and the sealing device comprises at least one protrusions which move outside of the door frame through a gap between the outer and inner walls.

6. The door structure of claim 5, wherein the protrusion comprises an electric material to tightly adhere to the outer and inner walls when moving, and tightly adheres to the guide rail when the door frame is closed.

7. The door structure of claim 5, wherein two protrusions are formed along a vertical direction substantially parallel with an extending direction of the door frame, and make contact with the guide rail when the door frame is closed.

* * * * *